US005588446A

United States Patent [19]

Clearman

[11] Patent Number: 5,588,446

[45] Date of Patent: Dec. 31, 1996

[54] CIGARETTE WITH IMPROVED CELLULOSIC SUBSTRATE

[75] Inventor: Jack F. Clearman, Blakely, Ga.

[73] Assignee: R. J. Reynolds Tobacco Company, Winston-Salem, N.C.

[21] Appl. No.: 305,405

[22] Filed: Sep. 13, 1994

Related U.S. Application Data

[63] Continuation of Ser. No. 71,132, Jun. 2, 1993.

[51] Int. Cl.[6] ..... A24F 1/22; A24F 47/00

[52] U.S. Cl. ..... 131/194

[58] Field of Search ..... 131/194, 359

[56] References Cited

U.S. PATENT DOCUMENTS

| | | | |
|---|---|---|---|
| 4,807,809 | 2/1989 | Pryor et al. | 131/84.1 |
| 4,893,637 | 1/1990 | Hancock et al. | 131/280 |
| 4,966,171 | 10/1990 | Serrano et al. | 131/194 |
| 5,183,062 | 2/1993 | Clearman | 131/194 |
| 5,203,355 | 4/1993 | Clearman | 131/359 |
| 5,247,947 | 9/1993 | Clearman et al. | 131/194 |

OTHER PUBLICATIONS

New Cigarette Prototypes That Heat Instead of Burn Tobacco, R J Reynolds Corp.

Leffingwell et al., Tobacco Flavoring For Smoking Products (1972).

U.S. patent application Ser. No. 07/710,273, filed Jun. 14, 1991.

U.S. patent application Ser. No. 07/882,209, filed May 13, 1992.

*Primary Examiner*—Jennifer Bahr

[57] ABSTRACT

The present invention provides improved cigarettes and other smoking articles in which the substrate is a cellulosic material, preferably paper or a paper-like material, e.g., tobacco paper. The substrate of the present invention is used to retain very high amounts of aerosol forming materials and flavorants, which, upon exposure to heated air passing through the aerosol generating means during smoking, are vaporized and delivered to the user as a smoke-like aerosol.

9 Claims, 2 Drawing Sheets

CIGARETTE WITH IMPROVED CELLULOSIC SUBSTRATE

This is a continuation of copending application Ser. No. 08/071,132 filed on Jun. 2, 1993.

BACKGROUND OF THE INVENTION

The present invention relates to smoking articles such as cigarettes, and in particular, to those smoking articles having a short fuel element and a physically separate aerosol generating means. These smoking articles are capable of providing the smoker with the pleasures of smoking (e.g., smoking taste, feel, satisfaction, and the like).

Cigarettes, cigars and pipes are popular smoking articles which use tobacco in various forms. As discussed in the background section of the aforementioned patent, many smoking articles have been proposed as improvements upon, or alternatives to, the various popular smoking articles.

Many of the smoking articles described in the prior art employ a combustible fuel element for heat generation and an aerosol generating means positioned physically separate from, but often in a heat exchange relationship with, the fuel element. The aerosol generating means typically includes one or more aerosol forming substances such as glycerin and a carrier or substrate therefor. These smoking articles also normally include tobacco in various forms such as cut filler, reconstituted tobaccos, densified pellets, tobacco dust and tobacco extracts, as well as tobacco flavor modifiers and tobacco flavoring agents. During smoking, heat generated by the fuel element acts to volatilize the aerosol forming substances, thereby providing an aerosol which resembles tobacco smoke. Such smoking articles yield extremely low levels of visible sidestream smoke as well as low levels of FTC "tar".

Many of the prior art smoking articles employ a substrate as a carrier for the aerosol forming substance in the aerosol generating means. Typically these substrates have been noncombustible solids, e.g., graphite, carbon, alumina, and the like, which are deemed heat-stable under the operating conditions of the smoking articles using them. In such articles the substrate was exposed to temperatures in the range of 400°–800° C., necessitating a heat-stable material. In U.S. Pat. Nos. 5,182,062 and 5,203,355 the substrate material was a cellulosic material such as a gathered paper, bearing an aerosol forming material at a loading level ranging from about 100% to about 400% by weight. The present invention represents an improvement in paper substrates for smoking articles.

SUMMARY OF THE INVENTION

The present invention provides improved cigarettes and other smoking articles employing short fuel elements and physically separate aerosol generating means in which the substrate is a cellulosic material bearing greater than about 400 percent by weight of an aerosol forming composition, preferably at from about 450–550 percent by weight, and in some cases up to 1000 percent by weight. The substrate material can be supersaturated with aerosol forming material. It has been found that these heretofore unknown high loading levels assure good quantities of delivered aerosol throughout the smoking profile, and also substantially eliminate the possibility of scorching of the cellulosic material by heat from the fuel element, even under stressed smoking conditions. "Stressed smoking conditions" refers to smoking conditions in which there is rapid draw and/or heavy draw by the smoker, with puff volume and/or puff frequency substantially greater (e.g. 150% or more greater) than those identified with FTC smoking conditions. At lower loading levels (e.g., below about 400%) stressed smoking conditions could lead to occasions of extreme scorching of the cellulosic substrate material, including possible sporadic ignition thereof.

The substrates of the present invention are cellulosic materials; that is, they primarily comprise cellulose, although additives and fillers may be included in the substrate. Preferred cellulosic materials used as substrates herein are wicking papers or paper-like materials, in the forms of sheets, webs, strands, filaments, strips, and the like. One preferred paper substrate of the present invention has the form of a non-woven, sheet-like paper material. This substrate typically is provided as a cylindrical segment in the form of a gathered web, within a circumscribing outer wrapper.

The substrates of the present invention retain aerosol forming materials and other ingredients, e.g., flavorants and the like, which upon exposure to heated gases passing through the aerosol generating means during puffing, are vaporized and delivered to the user as a smoke-like aerosol. As described above, the aerosol forming material loading on the substrates of the present invention is normally greater than about 400% by weight, preferably from about 450–550% by weight, and if desired, as much as 1000% by weight. Preferred aerosol forming materials used herein include glycerin, water, and the like, flavorants, and other optional ingredients.

Due to the heavy aerosol former loading on the present substrates, the design of the substrates can be modified from those previously known so as to prevent migration of the aerosol forming materials to the other cigarette components. It has been discovered that at the high loading levels of the present invention, mere overwrapping of the substrate with suitable barriers is not enough to prevent migration. The aerosol forming materials, especially at high load levels, tend to seek migration pathways, e.g., by capillary action, particularly through paper junctions in overwrapping materials used to assemble the cigarettes.

It has been discovered that the migration problems experienced with glycerin and similar aerosol forming materials can be substantially eradicated, even when the aerosol forming material or materials are present in extremely high amounts on the substrate, e.g. under supersaturated conditions, by isolating the substrate from the juncture of fibrous materials surrounding it such that the substrate is not in direct contact with the juncture or any of the cellulose (e.g., paper) material forming the juncture.

For example, in some previously known paper substrate smoking articles, a foil-lined paper tube was used as a barrier member around the substrate. The tube structure consisted of two adhesively joined materials, paper and aluminum foil. When formed into a tube (foil in/paper out), that structure afforded an exposed edge of the paper layer inside the tube, because an overlap juncture was typically employed (see FIG. 2A). Furthermore, during manufacture, upon cutting of the formed tube and the paper substrate, fibers from the paper material normally project from the edges of the paper. Thus, the loaded substrate was provided with direct contact to the paper of the tube, and if the loading was sufficiently high, migration could occur at this point. Thus, in this configuration higher levels of aerosol former could not be used.

It has now been discovered that this problem can be substantially overcome by isolating the juncture from the substrate. This can be accomplished by a new type of juncture overlap used in the formation of the foil-lined paper tube, in which there is sufficient thickness of the juncture overlap created by folding the laminate material that the substrate is separated from the juncture of the overlap (see FIG. 2B).

Another manner of preventing migration, which if desired may be used with or without the above-mentioned overlap juncture of FIG. 2B, involves deforming or providing the substrate member with a depression along the length of the substrate adjacent the overlap junction. Thus modified, the substrate avoids direct contact with the juncture and thereby prevents or substantially eliminates migration. These physical modifications are illustrated in the drawings accompanying this specification, and the skilled artisan will be able to design similar "non-touching" or "isolated" substrates.

As described above, the preferred smoking article includes a short (i.e., less than about 30 mm in length prior to smoking) preferably carbonaceous, combustible fuel element. Typically, the fuel element is an extruded mass, about 12 mm in length and about 4.2 mm in diameter which is provided with a plurality of longitudinally extending passageways, i.e., defined longitudinal hole(s) passing through the inner portion of the fuel element, and/or grooves located on the periphery of the fuel element.

The passageways provide a surface area which assists in the lighting of the fuel element, and in maintaining burning of the fuel element during smolder. The passageways also aid in controlling the heat transfer from the fuel element to the aerosol generating means. The density of a typical fuel element ranges from about 0.8 to about 1.3 g/cc. Fuel elements of this type are well known in this art.

Typically, the fuel element may be circumscribed by an insulating material in the form of a jacket. Jackets of this type are well known in the art, and a preferred jacket used herein includes alternating layers of glass fibers and tobacco paper. (See also, U.S. patent application Ser. No. 856,239 filed Mar. 25, 1992.)

The preferred cigarette smoking articles of the present invention also include a roll or charge of tobacco, normally in cut filler form, wrapped in a wrapping material such as paper, thereby forming a tobacco rod. A preferred tobacco roll is formed from cut filler comprising a reconstituted tobacco material. Alternatively, the tobacco charge can be in another processed form, such as volume expanded cut filler or aqueous extracted/volume expanded cut filler.

The substrate contains one or more aerosol forming materials. Such aerosol forming materials can include tobacco in any form, such as tobacco dust, spray dried tobacco extracts or tobacco essences; and tobacco flavoring agents such as sugars, licorice and cocoa. Other aerosol forming materials which may be used herein include polyhydric alcohols, such as glycerin, propylene glycol and triethylene glycol, which vaporize to produce a visible, "smoke-like" aerosol.

Preferred smoking articles also include a mouthend piece for delivering aerosol to the smoker, which in the case of cigarettes, typically have a tubular shape. However, the mouthend piece may be provided separately, e.g., in the form of a cigarette holder, or as a pipe. The mouthend piece of the preferred smoking articles typically includes a filter plug segment. Preferred filter segments exhibit low filtration efficiencies so as to minimize interference with the passage of aerosol from the aerosol generating means to the mouth of the smoker during draw (i.e., upon use). A segment of flavor-containing material, such as a loosely gathered or pleated tobacco paper or menthol-containing pleated carbon filled sheet can be included between the aerosol generating means and the filter segment. Examples of suitable mouthend pieces are well known in this art.

DETAILED DESCRIPTION OF THE PREFERRED EMBODIMENTS

Figure 1:
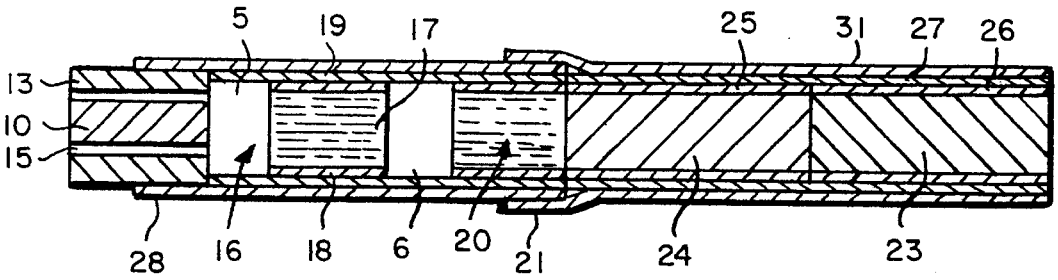
FIG. 1 is a longitudinal sectional view of a cigarette of the present invention.
Figure 1A:
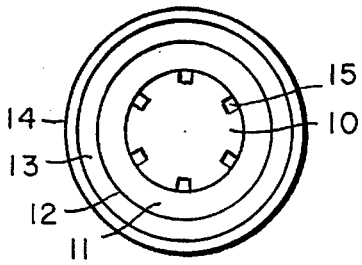
FIG. 1A is a front end view of the cigarette illustrated in FIG. 1.

The cigarette illustrated in FIG. 1 and 1A, has a fuel element 10, which includes a number of grooves 15 running along its longitudinal periphery. As shown, an insulating jacket surrounds the periphery of the fuel element, and, in the illustrated embodiment, comprises alternating layers of glass fibers and tobacco paper, arranged as concentric rings emanating outwardly from the fuel element in the following order; (a) a first glass fiber mat 11; (b) tobacco paper 12; and (c) a second glass fiber mat 13; and an outer paper wrapper 14. The outer paper wrapper 14 may comprise one layer or may be prepared from a plurality of separate layers, each having different porosity and ash stability characteristics.

The aerosol generating means, which includes substrate 16 contains one or more aerosol forming materials and/or flavorants is situated behind and spaced slightly apart from the insulated fuel element 10. This placement assists in preventing migration of the aerosol forming materials from the substrate to other components of the cigarette.

Substrate material 17 is overwrapped with a paper overwrap 18 which may include a barrier material to reduce or preferably prevent any migration of the aerosol forming materials from the substrate to other parts of the cigarette.

The substrate material 17 may be any one of a number of paper materials, including wood pulp paper, heat-stabilized paper, e.g., paper treated with one or more hydrated salts; tobacco paper and the like. (See U.S. Pat. Nos. 5,183,062, 5,203,335 and U.S. patent application Ser. No. 07/882,209, filed May 13, 1992.)

As illustrated, substrate 16 is positioned in a tube 19 so that void spaces 5 and 6 are provided at each end of the substrate plug 16. The tube is normally a laminated foil/paper combination employing the isolating juncture of the invention.

Figure 2A:
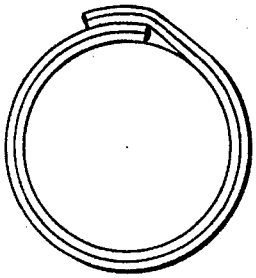
FIG. 2A PRIOR ART
FIG. 2A is a cross-sectional view of a substrate tubular container, illustrating a typical tube forming joint.
Figure 2B:
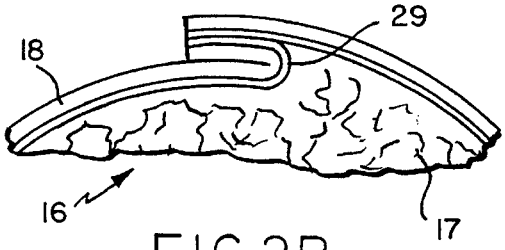
FIG. 2B is a cross-sectional view of an isolating joint of the present invention.
Figure 3:
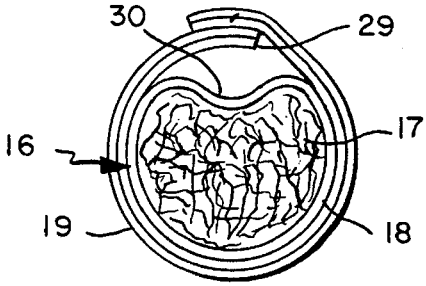
FIG. 3 is a cross-sectional view of a substrate segment of the present invention, showing one useful "depression" configuration as described herein.

FIG. 2B illustrates the overlap joint which assists in isolating the substrate 16 from the juncture 29 to assist in reducing or eliminating any migration of the aerosol former from the substrate 16 to other components of the cigarette. If desired, a depression 30 in the substrate adjacent to the juncture 29 can be employed (see FIG. 3).

Spaced longitudinally behind the substrate 16 in barrier tube 19 is a segment of reconstituted tobacco paper 20, overwrapped with paper 21. This tobacco paper segment is used to provide tobacco flavors to the aerosol emitted from the aerosol generating means. Tobacco paper segment 20 can be omitted if desired and a void space or other material substituted therefor, such as a carbon filler sheet containing a flavorant such as menthol. Alternatively, the substrate 16 can be lengthened and the tobacco paper shortened.

Longitudinally disposed behind the tobacco paper segment is a tobacco cut filler section 24, circumscribed by a paper wrapper 25. This segment adds additional tobacco flavors to the aerosol passing through.

Positioned at the extreme mouth end of the cigarette is a low-efficiency filter element 23, overwrapped with paper 26. Standard paper overwrap 27 combines the tobacco section 24 and the filter 23.

Circumscribing the insulated fuel element, at a point about 2 to 8 mm from the lighting end of the cigarette, and combining it with the barrier tube 19 is a non-burning paper wrapper 28. Wrapper 28 is preferably a laminated aluminum foil—paper structure. A tipping paper 31 is used to join the filter/tobacco cut filler segment to the front end segment to form the cigarette. This wrapper minimizes or prevents peripheral (radial) air from flowing to the portion of the fuel element disposed longitudinally behind its forward edge, thereby causing oxygen deprivation and preventing excessive combustion.

As described above, the aerosol generating means preferably includes cellulosic substrates. As defined herein, a "cellulosic material" is a material which is at least 50% by weight cellulose. Other absorbent or adsorbent materials, e.g., carbon, alumina, and the like, may be present in the cellulosic material (e.g., dispersed therein) if desired. The object of the substrate is to retain the aerosol forming material when not in use, and to release the aerosol forming material during smoking.

Some of the many cellulosic materials useful as substrates herein include; paper, wood pulp, rayon, plant or vegetable fibers, e.g., cotton, kapok, hemp, jute, and the like. Both woven and non-woven cellulosic materials are suitable for use as substrates. Papers, particularly nonwoven papers, are an especially preferred substrate material.

As illustrated in FIG. 1, the substrate and the fuel element are in a spaced apart relationship. Preferably the spacing ranges from about 1 mm to about 20 mm, most preferably from about 2 mm to about 10 mm. The length of the substrates of the present invention typically ranges from about 3 mm to about 40 mm, preferably from about 5 mm to about 30 mm. The diameter of the substrates range from about 3 mm to about 8 mm, preferably from about 6 to 8 mm, but if smaller diameter substrates are employed they may be surrounded by a sleeve of another material (e.g., tobacco) to fit within a cigarette.

The aerosol generating means also includes at least one aerosol forming material. The aerosol forming material generally has a liquid form. Examples of preferred aerosol forming materials include the polyhydric alcohols (e.g., glycerin, propylene glycol and triethylene glycol), the aliphatic esters of mono-, di-, or poly-carboxylic acids (e.g., methyl stearate, dimethyl dodecandioate and dimethyl tetradecanedioate), and the like.

Figure 4:
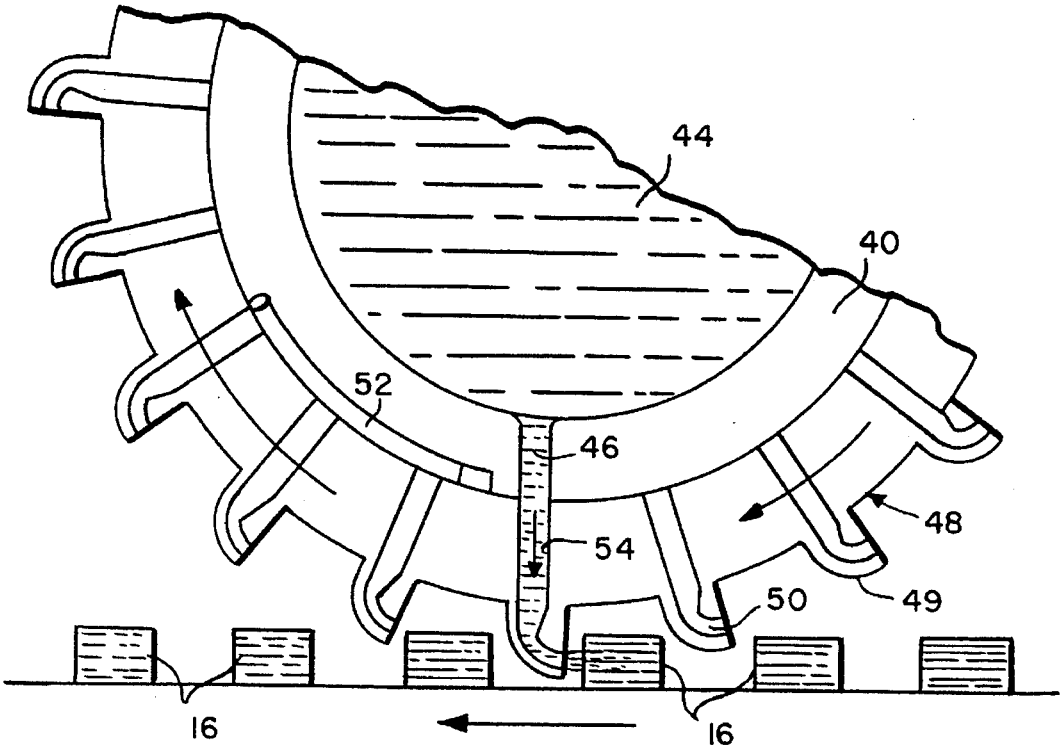
FIG. 4 is a sectional view of an apparatus useful in supplying the aerosol forming material to the substrate.

The loading of the aerosol forming material onto the substrate plug can be accomplished in numerous ways. The aerosol forming material may include a mixture of a polyhydric alcohol such as glycerin and volatile flavoring agents such as tobacco extracts, high fructose corn syrup, and the like. This mixture may be loaded onto the substrate by using a delivery wheel 39 as illustrated in FIG. 4. The substrate plugs 16 are spaced using a plug tube combiner apparatus such as a Mulfi available from Korber A.G. The delivery wheel is positioned above a conveyor for the substrate. The wheel has a stationary inner core 40 with a pressurized reservoir 42 of aerosol forming material 44. A bore 46 in the core wall extends from the reservoir to the periphery of the core. A rotating ring 48 concentric with the core has a plurality of spaced dispensing projections 49 having an L-shaped bore 54 extending through the ring outwardly to an orifice 50.

As the spaced substrates move along the conveyor and prior to entering the garniture of the wrapping apparatus, the projections of the delivery wheel are inserted between the spaced substrates. When a projection is in position between the substrates, the bores 46 and 54 are aligned. Aerosol forming material from the pressurized reservoir is forced through the bores and orifice into the forward face of the substrate plug. As the wheel continues to rotate, a vacuum is applied to the bore, thereby removing any excess aerosol forming material.

It has been discovered that the forward end of the substrate carrying an aerosol forming material mixture can scorch under stressed smoking conditions (i.e., ≧50 ml volume/puff of 2 seconds duration with 28 seconds of smolder). The scorching is a result of the slow wicking of the aerosol forming material to the face of the substrate, thereby permitting the substrate paper to be heated to a point that it will scorch. When scorching occurs, the forward face of the substrate becomes clogged, resulting in even slower wicking. This reduces the amount of aerosol delivered to the smoker and can produce an off-taste. By loading the polyhydric alcohol and the volatile flavoring agents separately on opposite faces of the substrate, the scorching of the substrate can be reduced. When the polyhydric alcohol alone is loaded on the forward face of the substrate, it wicks more easily so that the forward face remains soaked and the substrate face does not reach the temperature to scorch.

An apparatus similar to the one in FIG. 4 may be utilized to dispense the liquids to the opposite faces of the substrate plug. As will be apparent to those skilled in the art, the delivery wheel projections may have two separate bores communicating with a polyhydric alcohol reservoir and a separate flavoring agent reservoir. The bore orifices exit the projections in opposite direction so that as the projections enter the space between the substrates, the flavoring agent is injected onto the back face of a plug while the polyhydric alcohol is injected onto the forward face of the following adjacent plug.

Other metering devices for dispersing the required amount of the aerosol forming material will be apparent to those skilled in the art.

Examples of other aerosol forming materials include volatile flavoring agents and tobacco flavor modifiers. Volatile flavoring agents include vanillin, cocoa, licorice, organic acids, high fructose corn syrup, and the like. Various other flavoring agents for smoking articles are set forth in Leffingwell et al., *Tobacco Flavoring For Smoking Products* (1972). Tobacco flavor modifiers include levulinic acid, metal (e.g., sodium, potassium calcium and magnesium) salts of levulinic acid, and the like.

The fuel elements employed herein should meet three criteria; (1) they should be easy to ignite, (2) they should supply enough heat to produce aerosol for about 5–15, preferably about 8–12 puffs; and (3) they should not contribute off-taste or unpleasant aromas to the cigarette.

The preferred fuel element for use in the smoking articles of the present invention is manufactured from a combustible material in such a way that the density of the fuel element is greater than about 0.5 g/cc, frequently about 0.7 g/cc or more, often about 1 g/cc or more, sometimes about 1.5 g/cc or more, but typically less than about 2 g/cc. Additionally, the fuel element generally has a length, prior to burning, of less than about 20 mm, often less than about 15 mm, and preferably about 12 mm.

The composition of the combustible material of the fuel element can vary. Preferred fuel elements contain carbon, and highly preferred fuel elements are composed primarily of carbonaceous materials. Preferred carbonaceous materials have a carbon content above about 60 weight percent, more preferably above about 75 weight percent, and most preferably above about 85 weight percent. Flavors, tobacco extracts, fillers (e.g. clays or calcium carbonate), burn additives (e.g., sodium chloride to improve smoldering and act as a glow retardant), combustion modifying agents (e.g., potassium carbonate to control flammability), binders, and the like, can be incorporated into the fuel element.

Surrounding the outer periphery of the fuel element is an insulating wrapper. This wrapper, which may comprise glass fibers (e.g., E-glass, C-glass or the like), glass and tobacco materials, or other substitute insulating materials retains heat from the burning fuel element and directs it toward the aerosol generating means. Typical glass fibers for use in the insulating wrapper are described in *New Cigarette Prototypes that Heat Instead of Burn Tobacco*, R. J. Reynolds Tobacco Company, 1988, pages 48–52.

Typically, the length of the mouthend piece is such that (i) the burning portion of the fuel element and the hot heat conducting member are kept away from the mouth and fingers of the smoker; and (ii) vaporized aerosol forming materials have sufficient time to cool before reaching the mouth of the smoker. Often, it is highly desirable to provide a void space within the mouthend piece immediately behind the aerosol generating means. For example, a void space extending at least about 10 mm along the length of the smoking article may be provided immediately behind the aerosol generating means and forward of any materials situated in the mouthend piece.

The extreme mouthend of the smoking article preferably includes a filter element, or "filter tip." particularly for aesthetic reasons. Preferred filter elements are low efficiency filter elements which do not interfere appreciably with aerosol yields. Suitable filter materials include low efficiency cellulose acetate or polypropylene tow, baffled or hollow molded polypropylene materials, or gathered webs or nonwoven polypropylene materials. Suitable filter elements can be provided by gathering a non-woven polypropylene web available as PP-100-F from Kimberly-Clark Corp. using the filter rod forming apparatus described in Example 1 of U.S. Pat. No. 4,807,809 to Pryor et al.

The entire length of the smoking article, or any portion thereof, can be overwrapped with cigarette paper. Preferred papers which circumscribe the front end of the smoking article having the insulated fuel element and sleeve assembly, should not openly flame during use of the smoking article, should have controllable smolder properties, and should produce a gray ash. Suitable papers are well known in the art.

The smoking articles of the present invention incorporate one or more forms of tobacco. The form of the tobacco can vary, as can the location or locations of the tobacco in the particular smoking article. The tobacco can be incorporated in the fuel element, the aerosol generating means, and/or positioned within the mouthend piece in a manner so that various flavorful tobacco components are transferred to drawn aerosol passing through the mouthend piece. The type of tobacco can vary, and includes flue-cured, Burley, Maryland and Oriental tobaccos, and/or known rare and specialty tobaccos, as well as blends of any thereof.

Smoking articles of the present invention are capable of providing at least about 6 to about 10 puffs, when smoked under FTC smoking conditions. FTC smoking conditions consist of a 35 ml puff volume of 2 seconds duration, separated by 58 seconds of smolder. Preferred smoking articles of the present invention are capable of yielding at least about 0.6 mg of aerosol, measured as wet total particulate matter (WTPM), in the first 3 puffs, when smoked under FTC smoking conditions. Moreover, preferred smoking articles yield an average of at least about 0.2 mg of WTPM per puff, for at least about 6 puffs, preferably at least about 10 puffs, when smoked under FTC smoking conditions. Highly preferred smoking articles yield at least about 5 mg of WTPM over at least 10 puffs, when smoked under FTC smoking conditions.

The following examples are provided in order to further illustrate various embodiments of the invention, but should not be construed as limiting the scope thereof. Unless otherwise noted, all parts and percentages are by weight.

EXAMPLE 1

CIGARETTE OF FIG. 1

Fuel Element

A fuel element 12 mm long and 4.2 mm in diameter, and having an apparent (bulk) density of about 1.02 g/cc is prepared from about 72.6 parts hardwood pulp carbon having an average particle size of 12 μm in diameter, 10 parts ammonium alginate (Amoloid HV, Kelco Co.), 8.4 parts graphite powder, 1 part $Na_2CO_3$, 3 parts $CaCO_3$, and 5 parts ball-milled American blend tobacco.

The hardwood pulp carbon is prepared by carbonizing a non-talc containing grade of Grande Prairie Canadian kraft hardwood paper in an inert atmosphere, increasing the temperature in a step-wise manner sufficient to minimize oxidation of the paper, to a final carbonizing temperature of at least 750° C. The resulting carbon material is cooled in the inert atmosphere to less than 35° C., and then ground to fine power having an average particle size (as determined using a Microtrac Analyzer, Leeds & Northrup) of about 12≦m in diameter.

The finely powdered hardwood carbon is dry mixed with the graphite, $CaCO_3$, ammonium alginate binder, levulinic acid and the tobaccos, and then a 3 weight percent aqueous solution of $Na_2CO_3$ is added to provide an extrudable mixture, having a final sodium carbonate level of about 1 part.

Fuel rods (each about 24 inches long) are extruded using a screw extruder from the mixture having a generally cylindrical shape about 4.5 mm in diameter, with six (6) equally spaced peripheral grooves (about 0.5 mm wide and about 1 mm deep) with rounded bottoms, running from end to end. The extruded rods have an initial moisture level ranging from about 32–34 weight percent. They are dried at ambient temperature to a final moisture content of about 7–8 weight percent. The dried cylindrical rods are cut to a length of 12 mm using diamond tipped steel cutting wheels.

Insulating Jacket

A 4.2 mm diameter plastic tube is overwrapped with an insulating jacket material. The insulating jacket is composed of 2 layers of Owens-Corning C-glass mat, each about 1 mm thick prior to being compressed by a jacket forming machine (e.g., such as that described in U.S. Pat. No. 4,893,637), and after formation, each being about 0.6 mm thick. Sandwiched between the two layers of C-glass is one sheet of reconstituted tobacco paper, Kimberly-Clark's P-3510-176-60. A cigarette paper, designated P-3122-153 from Kimberly-Clark, overwraps the outer layer. The reconstituted tobacco paper sheet is a paper-like sheet made from tobacco, additionally containing a blended tobacco extract. The width of the reconstituted tobacco sheets prior to forming are 17 mm for the inner sheet and 25.5 mm for the outer sheet. The final diameter of the jacketed plastic tube is about 7.5 mm. The jacketed tube is cut into lengths of about 12 mm.

Substrate

A continuous substrate rod about 7.5 mm in diameter is formed from a highly embossed, 36 g/m$^2$, 102–152 mm wide web of paper available from Ecusta Division of PHGLADEFTER Co. as HP2-999724, e.g., on a modified KDF-2 web forming apparatus. (See U.S. Pat. No. 4,807,809). The substrate web weighs about 5.4 g/m. The substrate web is overwrapped with a paper/aluminum foil laminate having a width of about 25.5 mm to form a substrate rod. The foil in that laminate is cast aluminum, 0.0005 inches thick, and the paper is a Simpson Paper Company product known as RJR-002C paper. The laminate overwrap is formed with a commercial adhesive, Airflex 465 or silicate adhesive. The continuous substrate rod is cut into 10 mm plugs, weighing about 85 mg, which are then loaded with about 270 mg (500% of weight of substrate web) of glycerine/tobacco extract/flavorant aerosol former by spraying the glycerol on the ends of the substrate plugs.

Tobacco Paper Plug

A tobacco paper rod about 7.5 mm in diameter is formed from a medium embossed, 127 mm wide web of tobacco paper designated as P-144-GNA-CB available from Kimberly-Clark, e.g., using a rod forming apparatus such as that disclosed in U.S. Pat. No. 4,807,809. The rod is overwrapped with a 25.5 mm wide paper P1487-184-2 from Kimberly-Clark and cut into 10 mm lengths.

Front End Overwrap Tipping

A front end overwrap tipping paper is formed by laminating several papers including; an outer layer of Ecusta 29492 paper, an intermediate layer of 0.0005 inch thick aluminum foil and an inner layer of Ecusta 29492 paper. The laminated layers are held together with an adhesive, LAM 5001, from R. J. Reynolds Tobacco Co., using 1.5 pounds of adhesive per ream of paper.

Barrier Tube

A paper/foil tube about 7.5 mm diameter is made from a laminated web of RJR-002C paper from Simpson and 0.0005 inch aluminum foil about 29 mm wide. The tube seam is an isolating joint formed by folding back about 2 mm of one edge of the laminated web so that the paper is on the inside of the fold and then lap joining the other edge of the laminated web over the folded edge using a water based ethylene vinyl acetate adhesive (see FIG. 2B). The barrier tube is cut into 31 mm segments.

Filter Plug

A cellulose acetate filter rod about 7.5 mm diameter is formed from a 10/35,000 Denier tow width 0.6% triacetin overwrapped with a 25.5 mm wide web of 646 plug wrap available from Kimberly-Clark or Ecusta on a standard filter rodmaker. The overwrapped rod is cut into 20 mm length segments.

Tobacco Roll

A reconstituted tobacco cut filler prepared as described in U.S. patent application Ser. No. 07/710,273 filed Jun. 14, 1991, is formed into a rod about 7.5 mm in diameter and overwrapped with paper, e.g., using a Protos cigarette making apparatus from Korber A.G. The overwrapped tobacco roll is cut into 20 mm lengths.

Assembly of Cigarette

A. Front End Piece Assembly

A 10 mm long substrate piece is inserted into one end of the 31 mm long barrier tube and spaced about 5 mm from the end, thereby forming a void space of about 5 mm. Approximately 270 mg of a mixture comprising glycerin, tobacco extract and other flavors is applied to the substrate by spraying it on the ends of the substrate. A 10 mm long tobacco paper plug is inserted into the other end of the barrier tube until the end of the tobacco paper plug is flush with the end of the barrier tube leaving a 6 mm void space between the two plugs.

The plastic tube in the insulating jacket piece is removed and a 12 mm long fuel element is inserted so that the end of the fuel element is flush with the end of the insulating jacket.

A 12 mm long insulated fuel piece is aligned with the front end of the barrier tube so that the insulated fuel piece is adjacent the 5 mm void space in the barrier tube. The insulated fuel piece and the barrier tube are circumscribed with a piece of front end overwrap tipping paper, approximately 25.5 mm×37 mm. The tissue paper side of the overwrap paper is on the inside and a seam adhesive (MT 8009B) is used to seal the overlap joint. The 37 mm length of the overwrap is aligned in the longitudinal direction so that the overwrap paper extends from the free end of the barrier tube to approximately 6 mm over the insulated fuel, leaving approximately 6 mm of the insulated fuel exposed.

B. Mouthend Piece Assembly

A 20 mm filter plug and a 20 mm tobacco roll are combined with a 646 plug wrap using a standard adhesive.

The mouthend piece assembly and the front end piece assembly are aligned so that the tobacco roll abuts the tobacco paper plug and are secured together by a tipping paper about 45 mm in length to form a cigarette.

The cigarette is smoked, and yields visible aerosol and tobacco flavor (i.e., volatilized tobacco components) on all puffs for about 10–12 puffs. The fuel element burns to about 6 mm back, i.e., to about the region where the foil lined tube overwraps the fuel element, and there the cigarette self-extinguishes.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:

(a) a combustible fuel element less than about 30 mm in length prior to smoking; and (b) a physically separate aerosol generating means disposed longitudinally behind the fuel element comprising a cellulosic substrate material bearing an amount of aerosol forming material sufficient to substantially eliminate the burning of the substrate under smoking conditions of 50 ml volume per puff of 2 seconds duration, followed by 28 seconds of smolder, the substrate material being positioned in a barrier tube formed from a paper/foil laminated web having an isolating joint by which the substrate is isolated from contact with the paper layer of the paper/foil laminated web.

2. The smoking article of claim 1, wherein the cellulosic substrate bears from about 450 to about 550 weight percent of an aerosol forming material, based upon the dry weight of the substrate.

3. The smoking article of claim 1, wherein the cellulosic substrate material includes a rod of web material overwrapped with a paper overwrap.

4. The smoking article of claim 3, wherein the substrate material is positioned from about 1 mm to about 20 mm behind the fuel element.

5. A smoking article of claim 4, wherein migration from the substrate is substantially eliminated by the isolating joint.

6. The smoking article of claim 1, wherein the cellulosic substrate material includes a deformation therein in the region of the isolating joint.

7. The invention of claim 1 wherein the barrier tube comprises a paper/aluminum foil laminate having the foil on the inside surface of the tube, and the isolation joint is formed by folding over an edge of the paper/foil laminate so that the foil layer of the folded portion faces outwardly of the tube, and the joint is made with the foil layer of the folded edge contacting the foil layer of the other edge of the laminate.

8. A smoking article comprising:

(a) a combustible fuel element less than about 30 mm in length prior to smoking; and (b) a physically separate aerosol generating means disposed longitudinally behind the fuel element comprising a cellulosic substrate material bearing greater than about 400 percent by weight of an aerosol forming material, based upon the dry weight of the substrate;

wherein the cellulosic substrate includes a rod of web material overwrapped with a paper overwrap;

wherein the substrate is positioned in a barrier tube from about 1 mm to about 20 mm behind the fuel element; and wherein the barrier tube is formed from a paper/foil laminated web having an overlapping joint, and the substrate is deformed so that the substrate does not contact the overlapping joint of the barrier tube.

9. A smoking article comprising:

(a) a combustible fuel element less than about 30 mm in length prior to smoking; and (b) a physically separate aerosol generating means disposed longitudinally behind the fuel element comprising a cellulosic substrate material bearing at least about 400 percent by weight of an aerosol forming material, based upon the dry weight of the substrate;

wherein the cellulosic substrate includes a rod of web material overwrapped with a paper overwrap;

wherein the substrate is positioned in a barrier tube from about 1 mm to about 20 mm behind the fuel element;

wherein the tubular barrier member further includes an isolating joint, where by migration from the substrate is substantially eliminated;

wherein the cellulosic substrate material includes a deformation therein in the region of the isolating joint; and wherein the deformation of the cellulosic substrate material runs from end to end along the periphery thereof.

* * * * *